United States Patent [19]

Fisher

[11] Patent Number: 4,811,400

[45] Date of Patent: Mar. 7, 1989

[54] METHOD FOR TRANSFORMING SYMBOLIC DATA

[75] Inventor: William M. Fisher, Plano, Tex.

[73] Assignee: Texas Instruments Incorporated, Dallas, Tex.

[21] Appl. No.: 687,101

[22] Filed: Dec. 27, 1984

[51] Int. Cl.[4] ..... G10L 5/00

[52] U.S. Cl. ..... 381/44

[58] Field of Search ..... 364/513.5, 419, 44

[56] References Cited

U.S. PATENT DOCUMENTS 4,460,973 7/1984 Tanimoto et al. ..... 364/519

FOREIGN PATENT DOCUMENTS 2014765 8/1979 United Kingdom .

OTHER PUBLICATIONS

Kashyap et al., "Word Recognition etc.", IEEE Conf. on Pattern Recognition, Nov. 1976, pp. 626–631.

*Primary Examiner*—Emanuel S. Kemeny

*Attorney, Agent, or Firm*—William E. Hiller; N. Rhys Merrett; Melvin Sharp

[57] ABSTRACT

The specification discloses a method of transforming input symbolic data to output symbolic data for use in text-to-speech and other environments. A string of digital byte values representing the input symbolic data is stored in a first buffer memory location in rules processor (10). A set of rules defining a desired mapping of byte values is stored in a rules storage (12), along with a set of user special symbols. The rules ae sequentially mapped to transform the stored byte values in accordance with the rules and the special symbols from a first buffer memory location to a second buffer memory location.

12 Claims, 3 Drawing Sheets

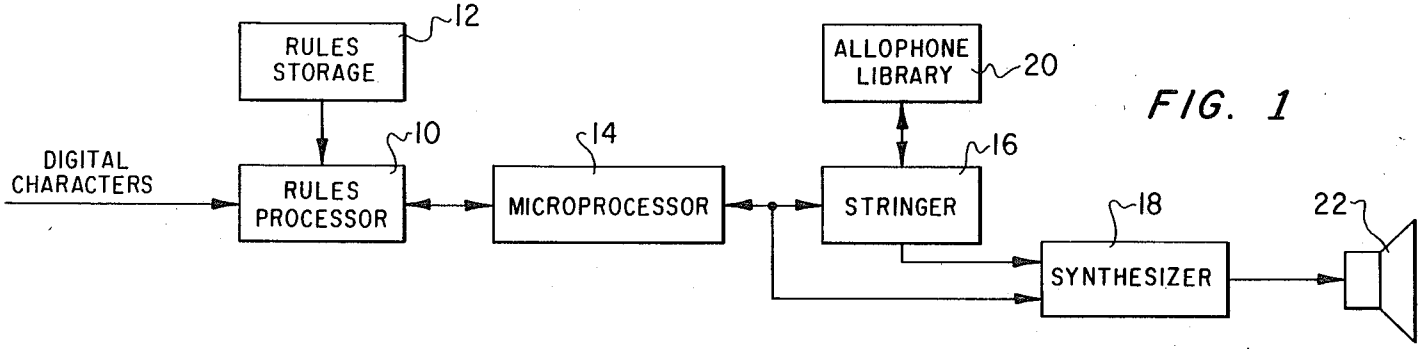
FIG. 1
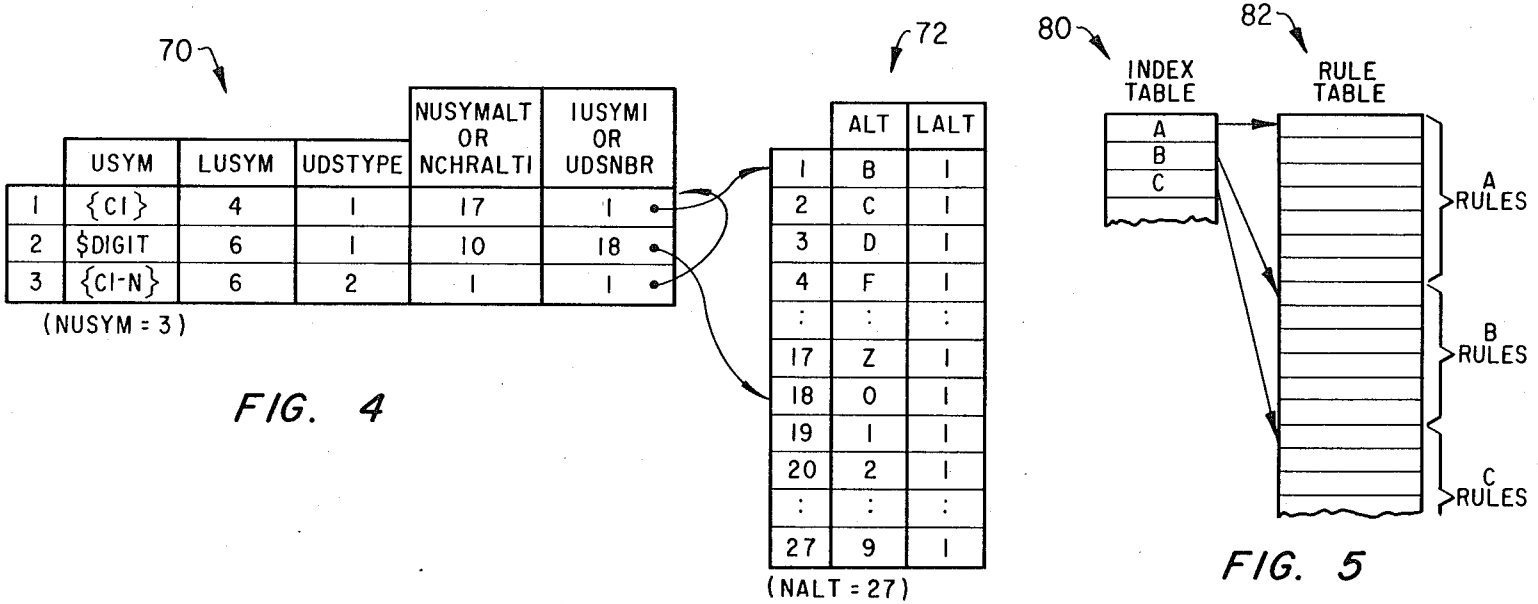
FIG. 4
FIG. 5

METHOD FOR TRANSFORMING SYMBOLIC DATA

TECHNICAL FIELD OF THE INVENTION

This invention relates to transformation of symbolic data, and more particularly relates to the transformation of input symbolic data to output symbolic data in accordance with rules sets for use in text-to-speech, word processing applications, cryptology and many other uses.

BACKGROUND OF THE INVENTION

Various techniques have heretofore been developed for transforming and manipulating symbolic data. For example, data transformation is useful in such applications as conversion of text into speech, word processing and in other areas of linguistics and artificial intelligence. The well-known Naval Research Laboratory rules have been implemented in Fortran language as described in "A Fast Fortran Implementation of the U.S. Naval Research Laboratory Algorithm for Automatic Translation of English Text to Votrax Parameters", by L. Robert Morris, IEEE ICASSP CH13799, pages 907–913, July, 1979. However, such approaches make it very difficult to improve operational performance by modification of the rules and are normally very specific and limited only to text-to-speech applications.

Other solutions to problems in the realms of linguistics and artificial intelligence have relied upon processes expressed as sets of pattern-matching rules which transform one set of symbolic data into another. For example, the article "Letter-to-Sound Rules for Automatic Translation of English Text to Phonetics", by H. S. Elovitz et al, IEEE Transactions on Accoustics, Speech and Signal Processing, Volume ASSP-24, No. 6, Pages 446–459, December, 1976, discloses a method for the automatic translation of English text to phonetics by means of letter-to-sound rules. However, this method is expensive and complicated because it uses rules stated in SNOBOL higher level language which requires the expense of a SNOBOL interpreting machine.

Several non-SNOBOL processes have been developed which interpret and apply pattern-matching rules such as written in the Elovitz et al format noted above. For example, note the Morris article noted above and the article entitled, "Speech Synthesis From Unrestricted Text Using a Small dictionary" by Richard Loose, NUSC Technical Report 6432, Feb. 10, 1981, Naval Underwater Systems Center, Newport, R.I. However, such methods are particularly adapted for the format of the Elovitz et al rules and thus do not have general and flexible applications.

A need has thus arisen for a symbolic data transformation method which is not limited to text-to-speech applications, but which is quite general and powerful and which may be used in a variety of applications. Such transformation method should be low-cost and not require implementation in higher level programming languages which require highly trained personnel and expensive interpreting machinery.

SUMMARY OF THE INVENTION

In accordance with the present invention, a method of transforming input symbolic data to a series of output symbolic data includes the steps of storing a linear array of digital byte values representing the input symbolic data in a first buffer memory location. A set of rules is stored defining a desired mapping of byte values. Each of the rules is sequentially applied to transform the stored byte values from the first buffer memory location to a second buffer memory location, the output buffer from one rule set serving as the input buffer for the next rule set.

In accordance with another aspect of the invention, a method of transforming a series of first symbols into a series of second symbols includes the steps of storing a set of special symbols each representing more than one of the first symbols. A source set of rules is also stored which defines the desired symbol transformations and utilizes the special symbols. The first symbols are transformed to the second symbols in accordance with the set of special symbols and the source set of rules.

In accordance with yet another aspect of the invention, a method of transforming a series of input symbolic data to a series of output symbolic data comprises storing a set of special symbols each representing a plurality of the input symbolic data. A source set of rules is also stored which defines desired symbolic data transformations and utilizes the special symbols. The rules each include a left environment, an input, a right environment and an output. The input symbolic data and the left and right environments associated with each input symbolic data are compared with the source set of rules. The input symbolic data is then transformed to the output symbolic data in response to valid comparisons with ones of the source set of rules.

BRIEF DESCRIPTION OF THE DRAWINGS

For a more complete understanding of the present invention, reference is now made to the following drawings, in which:

FIG. 1 is a block diagram of a typical text-to-speech system utilizing the rules of transformation of the present invention;

FIG. 4 is a representation of typical linked tables for storage of the user-defined symbols of the invention; and FIG. 5 is a representation of the rules indexing technique of the present invention.

DETAILED DESCRIPTION OF THE INVENTION

Figure 2:
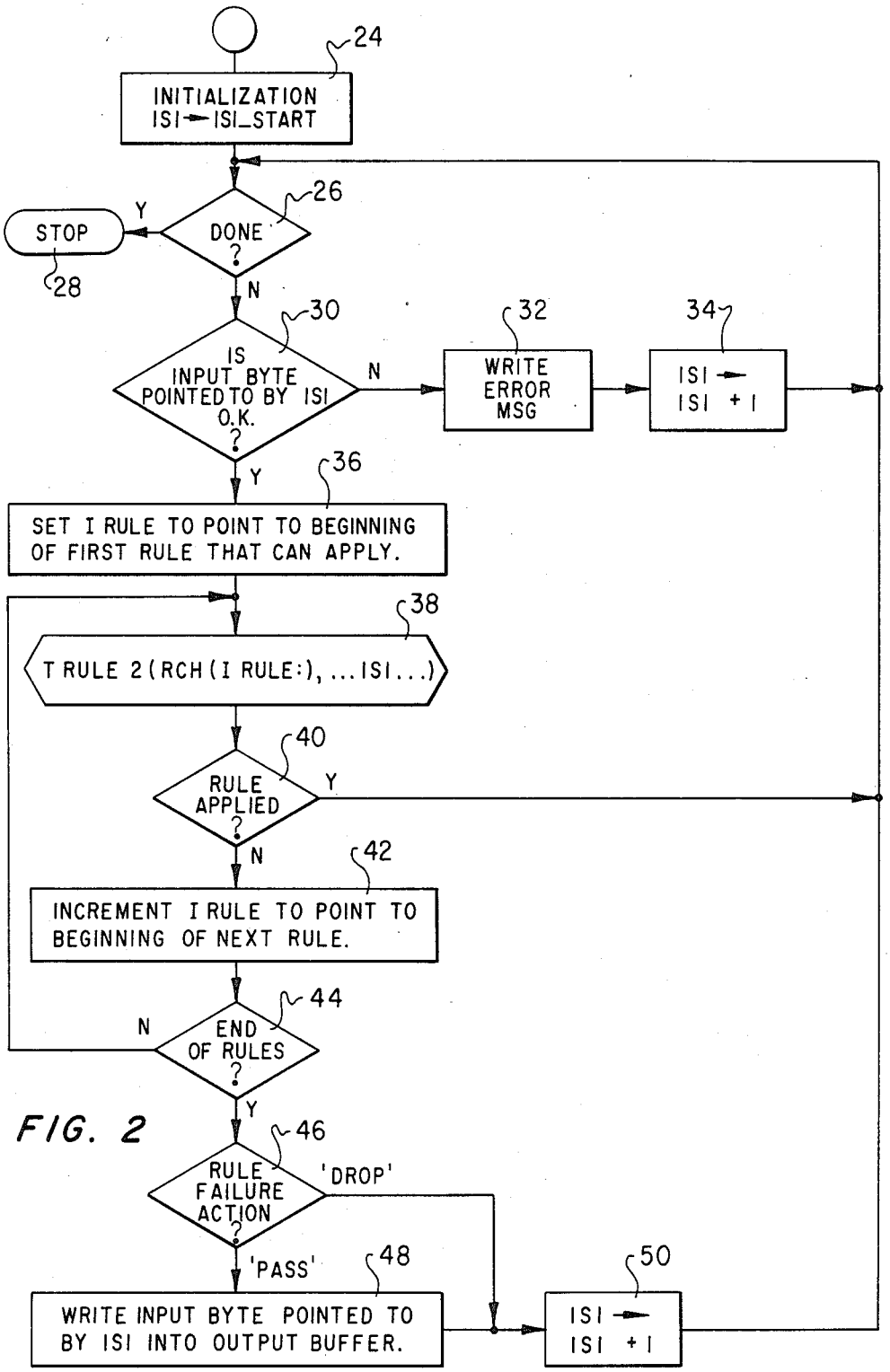
FIG. 2 is a computer flow diagram demonstrating the application of the transformation rules of the present invention.

Referring to FIG. 1, a typical text-to-speech system is illustrated in which the present transformation technique may be utilized. Although the invention will be described with respect to a text-to-speech system, it will be understood that an advantage of the present invention is that it is very generalized and its applications are not limited to text-to-speech applications. For example, the present technique may be utilized in word processing techniques, such as spelling correction and hyphenation, as well as in cryptology, and a variety of other linguistic and artificial intelligence applications.

Digital text code characters in the form of a byte string are applied to a rules processor 10 for comparison with a stored set of rules in a rules storage 12. After transformation of the digital characters by the stored rules in the rules processor 10, the transformed string of bytes, now representing allophones, is entered in the microprocessor 14 which is connected to control a stringer controller 16 and a voice audio synthesizer 18. An allophone library 20 is interconnected with the stringer to apply allophone parameter values to the stringer. The resulting audio output from the synthesizer 18 is output from a speaker 22 to provide speech-like sounds in response to the input allophonic code.

The rules processor 10 may comprise, for example, a Texas Instruments Inc. type TMCO 420 microcomputer. The rules storage 12 may comprise, for example, a Texas Instruments Inc Type TMS 6100 (TMC 3500) voice synthesis memory which is a ROM internally organized as 16K×8 bits. The microprocessor 14 may also comprise, for example, a type TMCO 420 microcomputer. The stringer 16 may comprise a Texas Instruments Inc. TMCO 356 controller. The allophone library may comprise, for example, a Texas Instruments Inc. type TMS 6100 ROM, or may, alternatively, comprise an internal ROM within the stringer 16. The synthesizer may be of the type described in U.S. Pat. No. 4,209,836 owned by the present assignee.

Additional detail of the construction and operation of the text-to-speech system of FIG. 1 may be found in U.S. Pat. No. 4,398,059 by Lin, et al and assigned to the present assignee and in pending U.S. patent application Ser. No. 240,694 filed Mar. 5, 1981 now U.S. Pat. No. 4,685,135 also by Lin, et al and assigned to the present assignee. Alternatively, the present transformation technique may be embodied in other digital processing systems such as a VAX computer or other suitable processors.

The present invention is primarily directed to the operation of the rules processor 10 and the rules storage 12. The present method transforms the input symbolic data represented by the digital characters input to the rules processor 10 into output symbolic data for application to the microprocessor 14. The present invention interprets and applies a data structure representing a set or sets of pattern matching rules, also termed source sets of rules. The present invention thus comprises an abstract finite-state transducer driven by table data. The digital characters input to the rules processor 10 will hereinafter be termed "input data" or "input symbolic data" and comprise a string of byte values. The output of the rules processor 10 will hereinafter be termed "output data" or "output symbolic data" which comprises a linear array of byte values which have been transformed in accordance with the rules storage 12.

The rules stored in the rules storage 12 comprise a series of one to N sets of rules which are applied iteratively to the input symbolic data. The input symbolic data is stored in a first buffer memory location in processor 10. The selected byte segments of the stored input symbolic data are compared to each of the rules in turn from the appropriate rules section (i.e., p-phoneme syllable rules), until one is found that matches. If one of the rules matches the input data, then the byte segments are transformed and placed in the second memory buffer. Next, the next selected byte segments are compared to each of the rules in turn (from the appropriate section for those bytes), and if a match is found, then the bytes are transformed by the rules. The 1 to N set of rules which can be applied iteratively refer to the process by which the output of one set of rules becomes the input symbolic data to the next set of rules. The number of rule sets to be applied in cascade is thus limited only by the amount of memory used in the system.

Each rule is composed of the traditional four parts; the left environment, the input or source, the right environment and the output or target. Each of the four parts of the rule are stored as byte values in the rules storage ROM 12.

Referring to FIG. 2, when it is desired to apply a rule, a memory register acting as a pointer or cursor is first initialized at step 24 with the address of the first byte value in the input buffer to be transformed. The local pointer is termed ISI and is set to the initialization value termed ISI START.

A check is made at step 26 as to whether or not all input bytes have been translated. If the answer is yes, the process stops at step 28. If the answer is no, a simple error check is made at step 30 on the input byte which is about to be translated. The check at 30 is a determination as to whether or not the ISI input byte is greater than the lowest possible input code and less than the highest possible input code. If the byte is not satisfactory, an error message is written at step 32 and the pointer to the input string is incremented by one character or one byte at step 34 and the process then loops back to the beginning of the process.

If the check at 30 is satisfactory, an index table is used at step 36 to point to the different rules inside the string of stored rules in ROM 12. At this step, another printer, which is termed the "I RULE", is set to point to the beginning of the first rule that can apply to the particular byte being reviewed. For example, if the input byte ISI represents the letter "A", then the "I RULE" is set to point to the beginning of the "A" rules. This technique thus allows indexing of rules to be utilized, as will be described with respect to FIG. 5, in order to shorten the search time of rules in accordance with the present invention.

After the index is set to point to the first rule that might apply, a subroutine TRULE 2 is called at step 38. TRULE 2 checks the rule designated by the pointer to determine if it matches the input byte string at the particular place being looked at in the program. If the rule matches the particular bytes, the subroutine moves the output part of the rule into the output memory buffer and increments the marker of the current end of the output memory buffer. If the rule is determined to apply, then the pointer is incremented to the input memory buffer to just beyond the bytes that have been transformed. The bytes are thus only transformed once by a particular rule set. This subroutine TRULE 2 also returns a parameter to indicate whether or not the rule comparison was successful. Details of the TRULE 2 subroutine will be subsequently described in greater detail in FIG. 3.

The parameter indicating whether the application of the rule was successful or not is checked at step 40. If the answer is yes, the program loops back to the major return point of the outside loop to step 26. If the rule was not applied, the pointer is incremented at step 42 from the prior rule to the point of the beginning of the next rule. At step 44, a check is made to determine whether or not all rules in a set have been applied. If the answer is no, the program loops back to the step 38 for iteration. The program thus conducts a linear search of the list of rules beginning at the initial point in the list of rules.

The system provides two possible ways to end the linear search of the rules. If the determination at step 44 is that the end of rules has been reached, a decision is made at 46 as to which of two possible rule failure actions will be utilized. The user of the system has the option of choosing either a "PASS" or "DROP" operation.

If the "PASS" operation is chosen, the input byte being pointed to by ISI is written into the output buffer without change at step 48. Thus, the byte being reviewed is not transformed but is passed unchanged into the storage string.

If the determination is made to "DROP" the unapplied byte, the "DROP" path is followed and the input byte being pointed to by ISI is not written into the output buffer, but is dropped. At step 50, the pointer is incremented by one with regard to the bytes in the input memory buffer. The main loop in the subroutine is then followed to iterate the routine.

Figure 3:
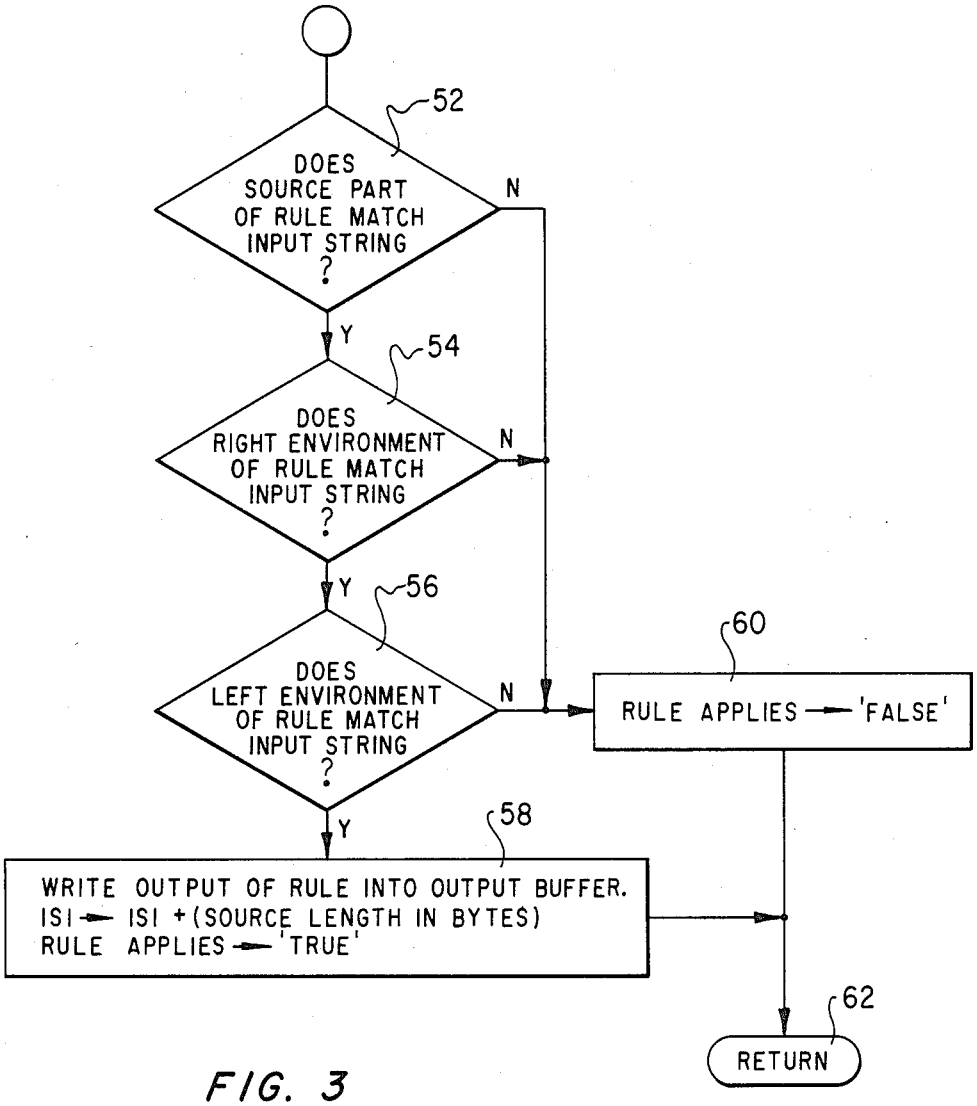
FIG. 3 is a computer flow diagram indicating the matching of the stored rules against input symbolic data.

FIG. 3 illustrates the TRULE 2 subroutine which performs the transformation of an input byte of symbolic data to output symbolic data. As noted, each of the stored rules in the memory includes four parts, namely, the left environment, the input, the right environment and the output. As will be subsequently described, the left and right environments are strings of symbols which may be either literal symbols in the input alphabet or symbols that stand for special user-defined symbols. At step 52, the source code of the rule is checked to determine if it matches the input byte string at the location being considered. If the answer is yes, the right environment is checked at step 54. A determination is made at 54 as to whether or not the right environment of the stored rule matches the right environment of the input byte string. If the answer is yes, a determination is made at step 56 as to whether the left environment of the stored rule matches the left environment of the input byte string.

At each of the steps 52, 54, and 56, the stored rule is decoded or unpacked from the data structure. If the stored rule does not match the input string at any of steps 52, 54 or 56, the rule does not supply and a Boolean flag is set in the algorithm and is returned to a calling program to indicate that the rule does not apply.

If the input, left environment and right environment of the rule matches the input byte string, the output of the rule is written at step 58 into the output memory buffer which contains the previously transformed string. The pointer is then incremented to the input string by the length of the output part of the rule. The indication that the rule applies is output to the return portion 62 for return to the program previously described in FIG. 2. Similarly, if the rule does not apply, a false flag is set at 60 and the subroutine goes to the return portion 62.

As previously indicated, the method set forth in FIGS. 2 and 3 may be implemented in FORTRAN or other suitable languages and run on any one of a number of digital processors. FORTRAN program listings of various subroutines for implementation of the procedures of FIGS. 2 and 3 are set forth on the attached Appendix A. In Appendix A, COMUDS is the coding that defines the data structure used to store the user-defined signals. The COMUDS is a listing of the common data area that is the data structure that stores the rules and the indexes to the rules. The next two pages are the COMUDS.

The S TRANS 2 subroutine corresponds to the flow chart shown on FIG. 2. The TRULE 2 corresponds to the flow chart shown on FIG. 3. The subroutine termed RUN PACK C unpacks the rule from the data structure into an easier to use representation.

The subroutine C MATCH 2 is used to actually apply the rules by matching the right environment against the input byte string. The subroutine CL MATCH 2 is used to match the left environment of the rule. The subroutine B MATCH 2 attempts to match single individual symbolic elements. The subroutine BL MATCH 2 is utilized by the CL MATCH 2 subroutine. The subroutine A MATCH 2 is utilized by B MATCH 2. The subroutine AL MATCH 2 is utilized by BL MATCH 2.

An important aspect of the invention is the provision of user-defined symbols in the rules. In the invention, the byte values in the input and output portions of a rule are interpreted literally. That is, in order for the rule to match, the byte values of the rule input must be the same as the corresponding byte values in the input memory buffer. If the rule matches, the literal byte values in the output part of the rule are stored into the output memory buffer as a transformed byte. The contents of the left and right environment, however, are interpreted more generally. If the value of a byte in one of the environmental parts of the rule is below a certain arbitrary value held in an auxiliary register, then that byte must be matched exactly and literally just as the bytes must be in the input and output rule parts. If the byte, however, does not meet this criteria, then it may be a "special symbol" which is interpreted as a pointer to a part of a separate data structure whose contents define a set of byte values, any one of which may match corresponding bytes of the input memory buffer. Two types of "special symbol" bytes may be defined in the data structure by the user. The first type of symbol (Type 1) is a pointer to a simple list of possible alternate byte values, the matching of any one of which counts as a match of the special symbol byte. Each of the entries in such a list consists of a string of one or more consecutive byte values, all of which must be matched exactly for the entry to match. The second type of symbol (Type 2) is a "N-OR-MORE" symbol wherein its defining data structure is found a value of a parameter N and a pointer to a special symbol of the first type. The Type 2 symbol will match N or more consecutive occurrences of the indicated Type 1 special symbol. In order to simplify the process using this data structure, the Type 1 special symbol in terms of which the Type 2 special symbol is defined, may be limited to a list of alternatives, each of which is a single byte value. N may have a value of 0 or more.

The user-defined symbol aspect of the present invention has several advantages. The user has another degree of freedom to be used in making up optimum rules by defining patterns perhaps not foreseen by the original programmer. By making up the user's own, more meaningful, names for the symbols, the user can make his rules more understandable and, at the same time, avoid the problems arising when the symbol itself occurs in the text. Further, the program coding is more general and, therefore, more compact.

The definitions of the user-defined symbols are contained in a section of the file of rules, normally before the actual stored source set of rules. Each user-defined symbol is defined by an equation. The left half of the equation is the representation of the user-defined symbol that will be used in the rules to follow and the right half specifies what character strings the user-defined symbol is supposed to match.

As noted, Type 1 symbols are defined as lists of alternate literals, which are enclosed in single quotes and separated by slashes, e.g.:

+='E'/'I'/'Y'

This defines the symbol "+" to match either "E" or "I" or "Y". Note that the user could equally well use a more meaningful name for the symbol:

{V+FRONT}='E'/'I'/'Y'

The alternate are not restricted to being one character long. This is a valid definition of a special symbol standing for a certain set of suffixes:

{SUFF1}='ER'/'E'/'ES'/'ED'/'ING'/'ELY'

Type 2 user-defined symbols are those whose definition implies a potentially infinite set of alternatives, such as N-OR-MORE. The interpretation of N-OR-MORE is straigtforward: N-OR-MORE (X) stands for N-OR-MORE concatenate appearances of the pattern X. The pattern X may be restricted, if desired, to a user-defined symbol of Type 1 whose alternates are single elements in the input alphabet of the rule set. That is, X specifies a subset of letters or other input characters. An example of a definition of "1 or more consonants" is:

*=1-OR-MORE (^)

Where "^" has previously been defined to be a consonant letter or a Type 1 user-defined symbol.

As an example of a user-defined symbol, consider a spelling correction system wherein it is desired to automatically correct the spelling of the typist. If it is desired to change the misspelled word "hte" to the correctly spelled word "the", the user types into the computer file of source rules:

[hte]→[the]/[b̄]__[b̄]

In this nomenclature, the / indicates "when it is found here" and the information after the / specifies the environment wherein the conversion may occur. The b indicates a blank and the environmental aspect of the rule may also be designated as [ ]__[ ] . .

In order to make the above-conversion more general, it may be desired to define a set of symbols in the user special symbol section by utilization of a special symbol as follows:

#='b'/'.'/';'/','/

Thus, a special user symbol has been defined wherein the # may equal either a blank, a period, a semi-colon or a comma. Thus, the above rule may be defined by the user more generally as follows:

[hte]→[the]/[#] [#]

With this equation, the program will correct the misspelled word, "hte" to the correct word "the" if the misspelled word is surrounded by any combination of a blank, period, semi-colon or a comma.

As another illustration of the utility of the Type 2 "N or more" special symbols, user-defined symbols may be defined as follows:

$P='.'/'?'/'!'

$B='b'

(B)=O-OR-MORE($B)

Consequently, another rule may be added to the source file of rules in order to correct a capitalization error:

[the]→[The]/[$P(B)] [#]

This rule will capitalize the "t" in "the" if there are any number of blanks on the left, ultimately preceded by a sentence-ending punctuation mark, and a blank, period, semicolon or comma on the right.

The stored rules normally include a header which defines the particular input such as ASCII code and the output code set which may comprise, for example, integer codes for phonemes. Also, the header may define what the user desires to happen if the rules do not apply, such as the drop or pass option previously described. The user-defined special symbols are then stored, followed by the body of the rule set in a text file.

Another aspect of the invention is that two or more sets of rules may be stacked and sequentially applied. The first set of rules may be applied during a first pass, followed by a second set of rules which are applied to the output of the first pass in a second pass, and so on. For example, a second pass of rules may be used to correct a multiple syllable boundary formed by the application of different rules.

The present system is also useful in text-to-speech conversion. For example, the "long A rule" may be implemented with the present system. First, all non-vowel consonants may be defined as follows:

{C}='B'/'C'/'D'/ . . .

Another special symbol may define a word boundary:

#='b'/';'/'.'/','/'-'/ . . .

The A RULE may thus be defined as:

[A]→[EY]/ [{C}E#]

Thus, if the system detects an "A" in the input, the "EY" sound is placed in the output if the letters to the right of the 'A' match the right environment of the rule (no left environment is specified). The right environment comprises a consonant, followed by an E and an end of a word, such as a blank, semi-colon, period, comma, or hyphen. Thus the word "rebate" matches the rule. However, the word "baseball" will not match as there is nothing to match the end of word.

If it is desired to match the word "baseball", a first rule pass may be used in order to insert a word boundary into the word, such rule being set forth as follows:

[E]→[E−]/ [BALL]

It will thus be seen that the special user symbol enables very easy input and utilization of a wide variety of very generalized rules.

FIG. 4 illustrates the two linked tables used to store data specifying user-defined symbols. The first table 70 contains one row of information for each user-defined symbol and the second table 72 holds the alternate literals used in user-defined symbol Type 1 definitions. FIG. 4 illustrates a typical user-defined symbol data structure holding the definitions of three user-defined symbols as follows:

{C1}='B'/'C'/'D'/'F'/ . . .

$DIGIT='0'/'1'/'2'/ . . .

{C1−N}=1-OR-MORE({C1})

The table 72 contains all of the alternate literals used in the definition of Type 1 symbols. NALT is the number of entries (in this case 27) in the alternate table. ALT(J) is a character string containing the alternate literal. LALT(J) is the number of characters in alternate J.

Table 70 has one entry of each user-defined symbol. The characters to be used to represent the user-defined number 1 are stored as a character string in USYM(I), of length LUSYM(I). UDSTYPE(I) records the type, either one or two, of the user-defined symbol. When the user-defined number 1 is of Type 1, as in the present example, then NUSYMALT(I) is the number of alternate literals defining the symbol. IUSYMI(I) is a pointer to the first alternate; that is, the first alternate for the user-defined 1 is ALT(IUSYMI)(I). If the user-defined symbol is of Type 2, then NCHRALT1(I) contains a number of repeated patterns in the first or smallest alternate for the user-defined symbol. This is the integer N in the "N-OR-MORE" function noted above. For such Type 2 symbols, UDSNBR(I) is a pointer to the user-defined symbol of Type 1 which specifies the repeated pattern and which was used as the argument "X" in the defintion using "N-OR-MORE (X)".

Since NUSYMALT(I) and NCHRALT1(I) are of the same data type and are in complementary distribution, the same area in core memory may be used to store them and the same may apply for IUSYM1(I) and UDSNBR(I).

Referring to the example set forth in FIG. 4, the data structure represents three user-defined symbols. The first, one consonant, is represented by the four characters "{C1}", is of Type 1, has 17 alternatives, and its first alternate is entry #1 in the alternate table, (a'B'). The second user-defined symbol, a digit, is represented by the six characters "$DIGIT", is of Type 1, has 10 alternates, and its first alternate is entry number 18 in the alternate table (a'B'). The third symbol, one or more consonants, is spelled by the six characters "{C1−N}", and is of Type 2 or a "one-or-more" type. The smallest number of concatenated patterns it will match is one, and the concatenated patterns themselves are defined as user-defined symbol number 1.

FIG. 5 illustrates the indexing table aspect of the present invention. As previously noted, in order to facilitate the searching of a long string of rules, it may be desired in some instances to group the rule and search only those rules indicated by a pointer in the index table. As shown in FIG. 5, the index table 80 includes a list of A,B,C . . . pointers. The rule table 82 includes the A RULES, B RULES, C RULES and the like grouped in sequential order. Thus, when the index table points to the A RULES, the programs noted in FIGS. 2 and 3 search only the A RULES. Similarly, when the index table points to the B RULES, the program searches only the B RULES. This results in a faster and more efficient search of rules triggered by a particular characteristic of the input byte being reviewed.

The present invention has been provided as a general transformer of byte strings, regardless of what those byte strings may symbolically represent. Thus, although the system is useful in converting text-to-phonetic symbols, it may be used in a variety of other linguistic and artificial intelligence transformations. For example, in the word processing area, a hyphenation rule may be used to mark the positions in English words at which end of line hyphens may be inserted. A text compression rule may be utilized to compress English text by using byte values not defined in the standard ASCII code to represent frequently occurring words or other strings of ASCII characters. Further, text-to-text rules may be utilized to expand common English abbreviations, such as "COL" into its full word form "COLONEL".

When the transformation technique is used in spelling correction, a set of rules with the "PASS" option described above may be utilized to transfer common misspellings into the correct spelling. The present technique is particularly efficient since most other spelling correctors use a lexicon of correct spellings in memory, while the present invention only requires a set of rules including only misspellings.

The system may also be utilized to transform singular English nouns into their plural forms, such as "ACE" becoming "ACES", "MAN" becoming "MEN" and "INDEX" becoming "INDICES". Further, rule sets may be used to convert a negative English clause into its corresponding positive form, such as "the man didn't come" to "the man came". Further, rules may be written to cover when a clause is changed from negative to positive, such that the word "any" is changed to "some". Further, the phrase "I don't want any" may be converted to "I want some". Additionally, rules may be written to interchange first and second person references when a response is made into a question. Accordingly, "Bats scare me" may be changed to "Do bats scare you?"

Rule sets may be used to convert numbers and dates written in Arabic numbers into their full word form, such that "328" may become "Three hundred and twenty eight". The conventional writing of doller and cents amounts may be transformed into their full word forms such that "$1.98" may be written as "One dollar and ninety eight cents".

The present invention provides a very flexible and powerful technique to provide transformations of symbolic data. Yet the present method is low cost and thus does not require higher level programming languages.

Although the preferred embodiment has been described in detail, it should be understood that various changes, substitutions and alterations can be made therein without departing from the spirit and scope of the invention as defined by the appended claims.

I. EXAMPLE OF MAIN-LINE CODING USING STRANS2 TO APPLY SYMBOLIC RULES

```
C DATA TO BE TRANSFORMED IS IN BSTR(1:PB)
      BSTR_INPUT=.TRUE.
```

```
C APPLY RULES
        DO 1800 IRLS=1,N_RULE_SETS
        IF (BSTR_INPUT) THEN
          CALL STRANS2(BSTR,1,PB,ASTR,PA,IRLS)
        ELSE
          CALL STRANS2(ASTR,1,PA,BSTR,PB,IRLS)
        ENDIF
1800    BSTR_INPUT=.NOT. BSTR_INPUT
C TRANSFORMED DATA (RULE OUTPUT) IS NOW IN BSTR(1:PB) IF
C BSTR_INPUT IS .TRUE., IN ASTR(1:PA) OTHERWISE.
```

II. DATA STRUCTURE DEFINITIONS INCLUDED IN SUBROUTINE CODING

A. FILE COMRDS.FOR COMMON DATA STRUCTURE FOR RULE DATA SETS

```
      PARAMETER NMAX_RULE_SETS=20
      PARAMETER NMAX_RCH=32000
      PARAMETER IND_MAX=2048
C
C  NECESSARY DATA:
C
C  STRING OF CODED RULES:
      CHARACTER*32000 RCH
C  RULE GROUP STOP CODE CHARACTER:
      CHARACTER RSTOP_CODE
C  INTERNAL STORAGE FORMAT TYPE:
C  ('A' (DEFAULT) = AS PACKED BY SUBROUTINE 'RPACKA')
C  ('C' = AS PACKED BY SUBROUTINE 'RPACKC')
      CHARACTER R_INTERNAL_FORMAT
C  INDEX TO STRING OF CODED RULES:
      INTEGER*2 IND(IND_MAX)
C  NUMBER OF RULE SETS:
      INTEGER*2 N_RULE_SETS
C  TABLES OF OFFSETS
      INTEGER*2 RCH_OFFSET(NMAX_RULE_SETS+1)
      INTEGER*2 IND_OFFSET(NMAX_RULE_SETS+1)
      INTEGER*2 UDS_OFFSET(NMAX_RULE_SETS+1)
C  TABLES DEFINING RANGE OF POSSIBLE VALUE FOR UDS CODES
      INTEGER*2 MIN_UDS_CODE(NMAX_RULE_SETS)
      INTEGER*2 MAX_UDS_CODE(NMAX_RULE_SETS)
C  WHAT TO DO IF RULES DON'T APPLY TO A SEGMENT:
C  (EITHER 'PASS' THE SEGMENT OR 'DROP' IT)
      CHARACTER*4 RFAIL_ACTION(NMAX_RULE_SETS)
C  TYPE OF INDEXING FOR EACH RULE SET:
C  ('A'=NO INDEXING,'B'=1-STAGE TABLE KEYED ON S(1:1)
      CHARACTER INDEX_TYPE(NMAX_RULE_SETS)
C
      COMMON /COMN_RDS_C/ RCH,RSTOP_CODE,RFAIL_ACTION,
     +                    ,INDEX_TYPE,R_INTERNAL_FORMAT
      COMMON /COMN_RDS_N/ IND
     +                    ,N_RULE_SETS
     +                    ,RCH_OFFSET,IND_OFFSET,UDS_OFFSET
     +                    ,MIN_UDS_CODE,MAX_UDS_CODE
C
C  AUXILIARY DATA:
C  NAMES OF RULE FILES
      CHARACTER*40 RFILENAME(NMAX_RULE_SETS)
C  POINTERS TO INPUT AND OUTPUT CODE SETS
```

```
      INTEGER*2 PCODE_IN(NMAX_RULE_SETS)
      INTEGER*2 PCODE_OUT(NMAX_RULE_SETS)
C TOTAL NUMBER OF RULES
      INTEGER*2 NRULES_TOT
C NUMBER OF RULES IN EACH RULE SET
      INTEGER*2 NRULES(NMAX_RULE_SETS)
C
      COMMON /COMA_RDS_C/ RFILENAME
      COMMON /COMA_RDS_N/ PCODE_IN,PCODE_OUT
     +                    ,NRULES_TOT,NRULES
```

B. FILE CMUDS.FOR COMMON AREA FOR USER-DEFINED SYMBOL TABLES

```
      PARAMETER MAX_USYMS=128
      PARAMETER MAX_USYM_ALTS=1024
C
      INTEGER*2 NUSYM! NBR OF USER-DEFINED SYMBOLS
      INTEGER*2 NALT! TOTAL NBR OF U.D.S. ALTERNATES IN TABLE
C               "ALT"
      INTEGER*2 LUSYM(MAX_USYMS)! LENGTH IN CHARACTERS OF EACH
C               USER-DEFINED SYMBOL
      INTEGER*2 IUSYM1(MAX_USYMS)! POINTER TO FIRST
C               ALTERNATIVE FOR EACH U.D.S.
      INTEGER*2 NUSYMALT(MAX_USYMS)! NUMBER OF ALTERNATES FOR
C               EACH UDS
      INTEGER*2 LALT(MAX_USYM_ALTS)! LENGTH IN CHARACTERS OF
C               EACH ALTERNATIVE
C NUMERIC DATA FOR TYPE 2 UDS:
      INTEGER*2 NCHRALT1(MAX_USYMS),UDSNBR(MAX_USYMS)
      EQUIVALENCE (NCHRALT1,NUSYMALT),(UDSNBR,IUSYM1)
      INTEGER*2 UDSTYPE(MAX_USYMS)
C
      CHARACTER*12 USYM(MAX_USYMS)! TABLE OF CHARACTER
C               REPRESENTTATIONS FOR EACH U.D.S.
      CHARACTER*6 ALT(MAX_USYM_ALTS)! TABLE OF CHARACTER
C               REPRESENTATIONS FOR EACH U.D.S. ALTERNATIVE
C
      COMMON /USYM_NBR_DATA/NUSYM,NALT,LUSYM,IUSYM1,NUSYMALT,
     +                      LALT, UDSTYPE
      COMMON /USYM_CHR_DATA/USYM,ALT
C
C COMUDS END
C
```

C. FILE COMPCODES.FOR COMMON DATA STRUCTURE FOR PCODE SETS

```
C ALL AUXILIARY DATA
C ** VERSION 2 - PCODENBR LOOKS LIKE A CHARACTER **
C ** VERSION 3 - 2-D ARRAYS REDUCED TO 1-D W/OFFSET PER
C CODESET**
C ** VERSION 4 - CONTAINS VARIABLES FOR MAX_SEG_CODE ETC.
C
      PARAMETER MAXPCODESETS=4
      PARAMETER MAXPCODES=512
      PARAMETER MAXPCHR=6
C MAXIMUM VALUES FOR THE 3 TYPES OF PC CODE:
      PARAMETER MAXTPCVAL=254
      PARAMETER MAXPPCVAL=254
      PARAMETER MAXAPCVAL=254
C
```

```
      CHARACTER*72 PCODEDESC(MAXPCODESETS)
      CHARACTER*40 PCODEFILE(MAXPCODESETS)
      LOGICAL SEPARATOR(MAXPCODESETS)
C NOTE: NEXT LINE SHOULD REALLY BE:
C     CHARACTER*MAXPCHR  PCODECHR(MAXPCODES)
      CHARACTER*6        PCODECHR(MAXPCODES)
      CHARACTER PCODENBR(MAXPCODES)
     +                        ,TYPE(MAXPCODESETS)
C NOTE: TYPE VALUES: T=TEXT,P=PHONOLOGICAL,A=PHONETIC
     +                        ,SEP_CODE(MAXPCODESETS)
C NOTE: IF (SEPARATOR(ICODE), SEP_CODE HOLDS THE SEPARATOR
C CODE
     +                        ,MIN_CODE(MAXPCODESETS)
     +                        ,MAX_CODE(MAXPCODESETS)
     +                        ,MIN_SEG_CODE(MAXPCODESETS)
     +                         ,MAX_SEG_CODE(MAXPCODESETS)
     +                         ,MIN_SUPRA_CODE(MAXPCODESETS)
     +                        ,MAX_SUPRA_CODE(MAXPCODESETS)
     +                         ,MIN_PARA_CODE(MAXPCODESETS)
     +                        ,MAX_PARA_CODE(MAXPCODESETS)
      INTEGER*2 LPCODECHR(MAXPCODES)
     +                         ,NPCODES(MAXPCODESETS)
     +                         ,OFFSET_PC(MAXPCODESETS)
     +                         ,NPCODESETS,NTOTOPCS
     +                         ,PARMAX(16),PARMIN(16)
C
      COMMON /PCHRDATA/PCODEFILE,PCODEDESC,PCODECHR,PCODENBR
     +                         ,MIN_CODE,MAX_CODE
     +                        ,MIN_SEG_CODE,MAX_SEG_CODE
     +                        ,MIN_SUPRA_CODE,MAX_SUPRA_CODE
     +                        ,MIN_PARA_CODE,MAX_PARA_CODE
     +                        ,TYPE,SEP_CODE
      COMMON /PNBRDATA/LPCODECHR,NPCODES,OFFSET_PC,NPCODESES,
     +                        ,NTOTPCS,PARMAX,PARMIN,SEPARATOR
C COMPCODES END
```

III. SUBROUTINE CODING

A. SUBROUTINE STRANS2.FOR

```
C
      SUBROUTINE STRANS2(IN_STR,ISI_START,ISI_END,
     +                       OUT_STR,ISO,
     +                       RULE_SET_NBR)
      CHARACTER*(*) IN_STR,OUT_STR
      INTEGER*2 ISI_START,ISI_END,ISO,RULE_SET_NBR
C
C *** NB-WHEN CHANGING, ALSO CHANGE STRANS2F AND STRANS2T ***
C
C APPLIES BYTE-STRING TRANSFORMING RULES TO INPUT STRING
C PRODUCING OUTPUT STRING
C INPUT STRING: IN_STR(ISI_START:ISI_END)
C OUTPUT STRING: OUT_STR(1:ISO)
C RULES TO BE APPLIED ARE FOUND IN COMMON AS RULE SET
C NUMBER <RULE_SET_NBR>
C NODIFIED 8/7/81 TO USE RULES PACKED INTO EITHER FORMAT 'A'
C OR 'C'
      INCLUDE '[FISHER.PROD]COMRDS.FOR'
      INCLUDE '[FISHER.PROD]COMPCODES.FOR'
C
```

```
C LOCAL VARIABLES:
      INTEGER*2 ISI,INDSTART,IBYTE,IRULE,LS,IX,LPR
      CHARACTERS IN_CHR,MIN_CODE_IN,MAX_CODE_IN
      LOGICAL RULE_APPLIED
C CODE:
D     TYPE *,' ENTERING STRANS2'
D     TYPE *,'   ISI_START=',ISI_START
D     TYPE *,'   ISI_END  =',ISI_END
D     DO 69 IDB=ISI_START,ISI_END
D     TYPE *,'   I=',IDB,', ICHAR(IN_STR(I:I))=',
D     ICHAR(IN_STR(IDB:IDB))
D69   CONTINUE
C OVER-ALL INITIALIZATION
      ISO=O
      ISI=ISI_START
C NOTE: ISI POINTS TO NEXT INPUT BYTE
C       ISO POINTS TO LAST BYTE WHICH WAS OUTPUT
      MIN_CODE_IN=MIN_CODE(PCODE_IN(RULE_SET_NBR))
      MAX_CODE_IN=MAX_CODE(PCODE_IN(RULE_SET_NBR)
      INDSTART=IND_OFFSET(RULE_SET_NBR)
C RETURN POINT FOR MAJOR LOOP ON ISI
100   CONTINUE
      IF (ISI .GT. ISI_END) GO TO 900
      IN_CHR=IN_STR(ISI:ISI)
      IBYTE=ICHAR(IN_CHR)
      IF ((IN_CHR .LT. MIN_CODE_IN).OR.
        (IN_CHR .GT. MAX_CODE_IN)) THEN WRITE(6,120)IBYTE,
        RULE_SET_NBR
120     FORMAT(' *STRANS FINDS INVALID INPUT CODE',I3
     +         /'  (APPLYING RULE SET',I2,')')
        ISI=ISI+1
        GO TO 100
      ENDIF
      IX=IBYTE+INDSTART
      IRULE=IND(IX)
      IF (IRULE .LT. 1) GO TO 300
200   CONTINUE
      IF (R_INTERNAL_FORMAT .EQ. 'C') THEN
        CALL TRULE2C(RCH(IRULE:),IN_STR,ISI,ISI_END
     +             ,RULE_APPLIED,OUT_STR,ISO,LPR,RULE_SET_NBR)
      ELSE
        CALL TRULE2A(RCH(IRULE:),IN_STR,ISI,ISI_END
     +             ,RULE APPLIED,OUT_STR,ISO,RULE_SET_NBR)
        LPR=ICHAR(RCH(IRULE:IRULE))
      ENDIF
      IF (RULE_APLIED) THEN
D       TYPE *,' RULE APPLIED'
D       IF (ISO .GT. 0) THEN
D         IDB1=ICHAR(OUT_STR(ISO:ISO))
D         TYPE *,' ISO=',ISO,' ICHAR(OUT_STR(ISO:ISO))=',IDB1
D       ELSE
D         TYPE *,' ISO NOT > 0 (NO OUTPUT YET)'
D       ENDIF
        GO TO 100
      ENDIF
C RULE DIDN'T APPLY
C BUMP RULE CODE POINTER BY LENGTH OF RULE
D     TYPE *,' RULE DID NOT APPLY'
      IRULE=IRULE+LPR
```

```
C IF MORE RULES IN THIS GROUP, GO BACK
      IF (RCH(IRULE:IRULE) .NE. RSTOP_CODE) GO TO 200
C OTHERWISE, NO RULE MATCHES THIS INPUT SEGMENT
300   CONTINUE
      IF (RFAIL_ACTION(RULE_SET_NBR) .EQ. 'PASS') THEN
        IF (ISO .GE. LEN(OUT_STR)) THEN
          TYPE *,' *STRAN2 HAS OUTBUFF OVF, LOSES'IBYTE
        ELSE
          ISO=ISO+1
          OUT_STR(ISO:ISO)=IN_CHR
        ENDIF
      ENDIF
      ISI=ISI+1
      GO TO 100
C
900   CONTINUE
      RETURN
      END
```

B. SUBROUTINE TRULE2A.FOR

```
      SUBROUTINE TRULE2A(RULE,IN_STR,ISI,ISI_RGT_LIM,
     +                   RULE_APPLIES,OUT_STR,ISO,
     +                  RULE_SET_NBR)
      CHARACTER*(*) IN_STR,OUT_STR,RULE
      INTEGER*2 ISI,ISI_RGT_LIM,ISO,RULE_SET_NBR
      LOGICAL RULE_APPLIES
C
C TRIES TO APPLY RULE TO STRING <IN_STR(1:ISI_RGT_LIM)>
C AT CURSOR POSITION <ISI>.
C RETURNS DECISION AS <RULE_APPLIES>, PLUS OUTPUT
C OF RULE IN OUT_STR(ISO1:ISO2), WHERE:
C  ISO1=VALUE OF ISO ON ENTRY + 1
C  ISO2=VALUE OF ISO ON EXIT
C IF RULE APPLIES, BUMPS ISI BY LENGTH OF S PART
C WORKS ONLY WITH RULES PACKED INTO INTERNAL FORMAT 'A'
C
C LOCAL VARIABLES:
      LOGICAL RE_MATCHES,LE_MATCHES
      INTEGER*2 ISI_RGT,ISO_RGT_LIM,LS,LT,LLE,LRE
     +          ,IR,ISAVE,LPR,IERR
     +          ,ISI_LIM,NEW_ISO,IX,ILRE,IRLE,L(4)
      EQUIVALENCE (LS,L(1)),(LRE,L(2)),(LLE,L(3)),(LT,L(4))
      CHARACTER*32 RPART
C LOGICAL SUBROUTINES:
      LOGICAL CMATCH2,CLMATCH2
C CODE:
C GET AND CHECK SOURCE PART OF RULE
      CALL RUNPACKA(RULE,LPR,L,RPART,1,ISAVE,IERR)
C (RPART NOW HOLDS "S" PART OF RULE)
D     TYPE*,'   IN TRULE2A'
D     TYPE*,'    ISI=',ISI,' ISI_RGT_LIM=',ISI_RGT_LIM
D     IDB1=ICHAR(RPART(1:1))
D     TYPE *,'    LS=',LS,' ICHAR(S(1:1((=',IDB1
      ISI_RGT=ISI+LS-1
      IF (ISI_RGT .GT. ISI_RGT_LIM) GO TO 8888
      IF (IN_STR(ISI:ISI_RGT) .NE. RPART(1:LS)) GO TO 8888
C SOURCE PART PASSES -- GET AND CHECK RIGHT ENVIRONMENT PART
      CALL RUNPACKA(RULE,LPR,L,RPART,2,ISAVE,IERR)
```

```
C (RPART NOW HOLDS "RE" PART OF RULE)
D     TYPE *,'    @IR=',IR,' LRE=',LRE
C IF LENGTH OF RE IS ZERO THEN RE MATCHES
      IF (LRE .LT. 1) GO TO 200
C OTHERWISE CHECK WITH SUBROUTINE
      ILRE=ISI+LS
      ISI_LIM=ISI_RGT_LIM-ILRE+1
D     TYPE *,'    JUST BEFORE CMATCH2, ILRE=',ILRE,'
     +                        LIM=',ISI_LIM
      RE_MATCHES=CMATCH2(RPART(1:LRE),LRE,IN_STR(ILRE:),ISI_LIM,
     +                        IX,RULE_SET_NBR)
C (NOTE: IX IS THE LENGTH OF MATCH, NOT USED AT PRESENT)
      IF (.NOT. RE_MATCHES) GO TO 8888
C RE PART PASSES -- GET AND CHECKLEFT ENVIRONMENT PART
200   CONTINUE
      CALL RUNPACKA(RULE,LPR,L,RPART,3,ISAVE,IERR)
C (RPART NOW HOLDS "LE" PART OF RULE)
C NOTE -- LLE = L(3)
D     TYPE *,'   @IR=',IR,' LLE=',LLE
      IF (LLE .EQ. 0) GO TO 300
      IRLE=ISI-1
      LE_MATCHES=CLMATCH2(RPART(1:LLE),LLE,IN_STR,IRLE,
     +                        IX,RULE_SET_NBR)
      IF (.NOT. LE_MATCHES) GO TO 8888
C LE PART PASSES -- RULE APPLIES !!!
300   CONTINUE
      CALL RUNPACKA(RULE,LPR,L,RPART,4,ISAVE,IERR)
C (RPART NOW HOLDS "T" PART OF RULE)
D     TYPE *,'   RULE MATCH, @IR=',IR,' LT=',LT
      IF (LT .LT. 1) GO TO 400
      NEW_ISO-ISO+LT
D     TYPE *,'   NEW_ISO=',NEW_ISO
      IF (NEW_ISO .GT. LEN(OUT_STR)) THEN
        TYPE *,' *TRULE2A HAS OUTBUFF OVF'
      ELSE
        OUT_STR(ISO+1:)=RPART(1:LT)
        ISO=NEW_ISO
      ENDIF
400   RULE_APPLIES = .TRUE.
      ISI=ISI+LS
      GO TO 9999
C FAILURE -- RULE DOES NOT APPLY
8888  CONTINUE
      RULE_APPLIES = .FALSE.
C EXIT
9999  CONTINUE
      RETURN
      END
```

C. SUBROUTINE TRULE2C.FOR

```
      SUBROUTINE TRULE2C(RULE,IN_STR,ISI,ISI_RGT_LIM,
     +                        RULE_APPLIES,OUT_STR,ISO,LPR,
     +                        RULE_SET_NBR)
      CHARACTER*(*) IN_STR,OUT_STR,RULE
      INTEGER*2 ISI,ISI_RGT_LIM,ISO,LPR,RULE_SET_NBR
      LOGICAL RULE_APPLIES
C
C TRIES TO APPLY RULE TO STRING <IN_STR(1:ISI_RGT_LIM)>
```

```
C AT CURSOR POSITION <ISI>.
C RETURNS DECISION AS <RULE_APPLIES>, PLUS OUTPUT
C OF RULE IN OUT_STR§ISO1:ISO2), WHERE:
C  ISO1=VALUE OF ISO ON ENTRY + 1
C  ISO2=VLAUE OF ISO ON EXIT
C IF RULE APPLIES, BUMPS ISI BY LENGTH OF S PART
C LENGTH OF PACKED RULE RETURNED IN LPR
C
C WORKS ONLY WITH RULES PACKED INTO INTERNAL FORMAT 'C'
C
C LOCAL VARIABLES:
      LOGICAL RE_MATCHES,LE_MATCHES
      INTEGER*2 ISI_RGT,ISO_RGT_LIM,LS,LT,LLE,LRE
     +          ,IR,ISAVE,LS_CODED
     +          ,ISI_LIM,NEW_ISO,IX,ILRE,IRLE,L(4)
      EQUIVALENCE (LS_CODED,L(1)),(LRE,L(2)),(LLE,L(3))
     +          ,(LT,L(4))
      CHARACTER*32 S,RE,LE,T
      EQUIVALENCE (S,RE,LE,T)
C LOGICAL SUBROUTINES:
      LOGICAL CMATCH2,CLMATCH2
C CODE:
C GET AND CHECK SOURCE PART OF RULE
      CALL RUNPACKC(RULE,LPR,L,S.1,ISAVE,IERR)
D     TYPE *,'   IN TRULE2C'
D     TYPE *,'    ISI=',ISI,' ISI_RGT_LIM=',ISI_RGT_LIM
D     IDB1=ICHAR(S(1:1))
D     TYPE *,'    LS=',LS,' ICHAR(S(1:1)=';,IDB1
      LS=LS_CODE+1
      ISI_RGT=ISI+LS-1
      IF (ISI_RGT .GT. ISI_RGT_LIM) GO TO 8888
      IF (IN_STR(ISI+1:ISI_RGT) .NE. S(1:LS_CODED)) GO TO 8888
C SOURCE PART PASSES -- GET AND CHECK RIGHT ENVIRONMENT PART
      CALL RUNPACKC(RULE,LPR,L,RE,2,ISAVE,IERR)
D     TYPE *,'    @IR=',IR,' LRE=',LRE
C IF LENGTH OF RE IS ZERO THEN RE MATCHES
      IF (LRE .LT. 1) GO TO 200
C OTHERWISE CHECK WITH SUBROUTINE
      ILRE=ISI+LS
      ISI_LIM=ISI_RGT_LIM-ILRE+1
D     TYPE *,'    JUST BEFORE CMATCH2, ILRE=',ILRE,' LIM='
     +                        ,ISI_LIM
      RE_MATCHES=CMATCH2(RE(1:LRE),LRE,IN_STR(ILRE:),ISI_LIM,
     +                        IX,RULE_SET_NBR)
C (NOTE: IX IS THE LENGTH OF MATCH, NOT USED AT PRESENT)
      IF (.NOT RE_MATCHES) GO TO 8888
C RE PART PASSES -- GET AND CHECK LEFT ENVIRONMENT PART
200   CONTINUE
      CALL RUNPACKC(RULE,LPR,L,LE,3,ISAVE,IERR)
C NOTE -- LLE = L(3)
D     TYPE *,'   @IR=',IR,' LLE=',LLE
      IF (LLE .EQ. 0) GO TO 300
      IRLE=ISI-1
      LE_MATCHES=CLMATCH2(LE(1:LLE),LLE,IN_STR,IRLE,
     +                        IX,RULE_SET_NBR)
      IF (.NOT. LE_MATCHES) GO TO 8888
C LE PART PASSES -- RULE APPLIES !!!
300   CONTINUE
      CALL RUNPACKC(RULE,LPR,L,T,4,ISAVE,IERR)
D     TYPE *,'   RULE MATCH, @IR=',IR,' LT=',LT
```

```
      IF (LT .LT. 1) GO TO 400
      NEW_ISO=ISO+LT
D     TYPE *,'   NEW_ISO=',NEW_ISO
      IF (NEW_ISO .GT. LEN(OUT_STR)) THEN
        TYPE *,' *TRULE2C HAS OUTBUFF OVF'
      ELSE
        OUT_STR(ISO+1:)=T(1:LT)
        ISO=NEW_ISO
      ENDIF
400 RULE_APPLIES = .TRUE.
      ISI=ISI+LS
      GO TO 9999
C FAILURE -- RULE DOES NOT APPLY
8888  CONTINUE
      RULE_APPLIES = .FALSE.
C EXIT
9999  CONTINUE
      RETURN
      END
```

D. FILE CMATCH2.FOR

```
      LOGICAL FUNCTION CMATCH2(PAT,PATLIM,STR,STRLIM,
     +                         LSTRMATCH,IRLS)
      CHARACTER*(*) PAT,STR
      INTEGER*2 PATLIM,STRLIM,LSTRMATCH,IRLS
C
C CMATCH TRIES TO MATCH THE PATTERN IN PAT TO THE STRING IN
C STR.
C LIMITS ARE PAT(1:PATLIM), STR(1:STRLIM)
C IRLS IS THE RULE SET NUMBER
C LSTRMATCH RETURNS THE NUMBER OF STRING ELEMENTS MATCHED IN
C STR.
C IF SUCCESSFUL, CMATCH=.TRUE. AND THE STRING WAS MATCHED
C OVER STR(1:LSTRMATCH).  IF NOT SUCCESSFUL, CMATCH=.FALSE.
C AND LSTRMATCH=0
C OPERATES IN LEFT ANCHOR MODE,I.E., STR(1:1) MUST BE MATCHED
C BY PAT(1:1)
C
C LOCAL DATA:
      PARAMETER IPATLIM=16
      INTEGER*2 JALT(IPATLIM),LM(IPATLIM),IPAT
C JALT(IPAT) IS A POINTER TO THE ALTERNATIVE OF PATTERN ELEMENT
C PAT(IPAT)
C LM(IPAT) IS THE LENGTH OF THE STRING MATCHED BY PAT(IPAT)
      LOGICAL B,BMATCH2
C
D     TYPE *,'      CMATCH2 ENTERED'
D     TYPE *,'      PATLIM=',PATLIM,' STRLIM=',STRLIM
      LSTRMATCH = 0
      IPAT = 1
100   CONTINUE
      JALT(IPAT) = 0
200   CONTINUE
D     TYPE *,'      JUST BEFORE CALL TO BMATCH2,IPAT=',IPAT
      B=BMATCH2(PAT(IPAT:IPAT),STR,LSTRMATCH+1,LM(IPAT)
     +          ,STRLIM,JALT(IPAT),IRLS)
D     TYPE *,'      JUST AFTER RETURN FROM BMATCH2'
      IF (B) THEN
```

```
          LSTRMATCH = LSTRMATCH + LM(IPAT)
          IF (IPAT .LT. PATLIM) THEN
              IPAT = IPAT + 1
              GO TO 100
            ELSE
      CMATCH2 = .TRUE.
      TYPE *,'    LEAVING CMATCH2, TRUE, LSTRMATCH=',LSTRMATCH
      RETURN
         ENDIF
       ELSE
         IF (IPAT .GT. 1) THEN
      IPAT = IPAT - 1
      LSTRMATCH = LSTRMATCH - LM(IPAT)
      GO TO 200
            ELSE
       CMATCH2 = .FALSE.
D      TYPE *,'    LEAVING CMATCH2, FALSE,
      +                       LSTRMATCH=',LSTRMATCH
      RETURN
          ENDIF
      ENDIF
      END
```

E. FILE CLMATCH2.FOR

```
      LOGICAL FUNCTION CLMATCH2(PAT,PATLIM,STR,STRLIM,
     +                          LSTRMATCH,IRLS)
      CHARACTER*(*) PAT,STR
      INTEGER*2 (PATLIM,STRLIM,LSTRMATCH,IRLS
C
C CLMATCH2 TRIES TO MATCH THE PATTERN IN PAT TO THE STRING IN
C STR.
C LIMITS ARE PAT(1:PATLIM), STR(1:STRLIM)
C IRLS IS THE RULE SET NUMBER
C THIS ROUTINE IS A VARIANT OF CMATCH, LOOKING FROM RIGHT
C TO LEFT INSTEAD OF FROM LEFT TO RIGHT!!
C IF SUCCESSFUL, CLMATCH2=.TRUE. AND THE STRING WAS MATCHED
C OVER STR(LSTRMATCH:STRLIM).  IF NOT SUCCESSFUL, CLMATCH2=
C .FALSE. OPERATES IN RIGHT ANCHOR MODE, I.E.,
C STR(STRLIM:STRLIM) MUST BE MATCHED BY PAT(PATLIM:PATLIM).
C
C LOCAL DATA:
      PARAMETER IPATLIM=16
      INTEGER*2 JALT(IPATLIM),LM(IPATLIM)
C JALT(IPAT) IS A POINTER TO THE ALTERNATIVE OF PATTERN ELEMENT
C PAT(IPAT)
C LM(IPAT) IS THE LENGTH OF THE STRING MATCHED BY PAT(IPAT)
      LOGICAL B,BLMATCH2
C
D     TYPE *,' ENTERING CLMATCH2, PAT=',PAT(1:PATLIM)
D     TYPE *,'  PATLIM=',PATLIM
D     TYPE *,'  STR=',STR(1:STRLIM)
D     TYPE *,'  STRLIM=',STRLIM,', LSTRMATCH=',LSTRMATCH
      LSTRMATCH = STRLIM+1
      IPAT = PATLIM
100   CONTINUE
      JALT(IPAT) = 0
```

```
200   CONTINUE
      B=BLMATCH2(PAT(IPAT:IPAT),STR,LSTRMATCH-1,LM(IPAT),
     +           JALT(IPAT),IRLS)
      IF (B) THEN
          LSTRMATCH = LSTRMATCH - LM(IPAT)
          IF (IPAT .GT. 1) THEN
              IPAT = IPT - 1
              GO TO 100
            ELSE
      CLMATCH2 = .TRUE.
      RETURN
         ENDIF
       ELSE
         IF (IPAT .LT. PATLIM) THEN
      IPAT = IPAT + 1
      LSTRMATCH = LSTRMATCH + LM(IPAT)
      GO TO 200
           ELSE
       CLMATCH2 = .FALSE.
       RETURN
          ENDIF
      ENDIF
      END
```

F. SUBROUTINE RUNPACKA.FOR

```
      SUBROUTINE RUNPACKA(PACKED_RULE,LRP,L,RULE_PART,JPART,
     +                    I,IERR)
      CHARACTER*(*) PACKED_RULE
      CHARACTER*32 RULE_PART
      INTEGER*2 LRP,L(4),JPRT,I
C
C UNPACKS A RULE FROM A SINGLE CHARACTER STRING INTO
C A GENERAL INTERNAL FORM.
C
C WORKS WITH RULES PACKED INTO INTERNAL FORMAT 'A'.
C
C IF JPART=N, THE NTH PART OF THE RULE IS UNPACKED AND RETURNED
C WHEN JPART=1, THE TOTAL LENGTH OF THE RULE IS ALSO RETURNED.
C I IS A POINTER WHOSE VALUE MUST BE PRESERVED BETWEEN CALLS.
C THE VALUES OF JPART ON SUCCESSIVE CALLS SHOULD BE 1,2,3,4.
C THE PACKED RULE STRING IS FOUND IN PACKED_RULE(1:).
C FOR PROPER RULE PACKING, USE RPACKA.
C IN THIS VERSION, THE RULE IS PACKED AS:
C BYTE 1 : TOTAL LENGTH OF RULE IN BYTES
C NEXT (LS+1) BYTES: 1 BYTE HOLDING LENGTH OF S PART OF RULE,
C        FOLLOWED BY THE BYTES COMPRISING THE S PART
C NEXT (LRE+1) BYTES: 1 BYTE HOLDING LENGTH OF RE PART OF RULE,
C        FOLLOWED BY THE BYTES COMPRISING THE RE PART
C NEXT (LLE+1) BYTES: 1 BYTE HOLDING LENGTH OF LE PART OF RULE,
C        FOLLOWED BY THE BYTES COMPRISING THE LE PART
C NEXT (LT+1) BYTES 1 BYTE HOLDING LENGTH OF T PART OF RULE,
C        FOLLOWED BY THE BYTES COMPRISING THE T PART
C TOTAL LENGTH OF PACKED RULE = LS+LRE+LLE+LT+5
C
C
C RETURNS IERR > 0 IFF ERROR
C
C LOCAL DATA
```

```
      INTEGER*2 LX
C CODE
      IERR=0
      IF (JPART .EQ. 1) THEN
        LPR=ICHAR(PACKED_RULE(1:1)
        IF (LPR .LT. 1) GO TO 9999
        I=2
      ENDIF
      LX=ICHAR(PACKED_RULE(I:I))
      L(JPART)=LX
      IF (LX .GT. 0) RULE_PART=PACKED_RULE(I+1:I+LX)
200   I=I+LX+1
9999  RETURN
      END
```

G. SUBROUTINE RUNPACKC.FOR

```
      SUBROUTINE RUNPACKC(PACKED_RULE,LPR,L,RULE_PART,JPART,
     +                    I,IERR)
      CHARACTER*(*) PACKED_RULE
      CHARACTER*32 RULE_PART
      INTEGER*2 LPR,L(4),JPART,I
C
C UNPACKS A RULE FROM A SINGLE CHARACTER STRING INTO
C A GENERAL INTERNAL FORM.
C
C WORKS WITH RULES PACKED INTO INTERNAL FORMAT 'C'.
C
C IF JPART=N, THE NTH PART OF THE RULE IS UNPACKED AND RETURNED
C WHEN JPART=1, THE TOTAL LENGTH OF THE RULE IS ALSO RETURNED.
C I IS A POINTER WHOSE VALUE MUST BE PRESERVED BETWEEN CALLS.
C THE VALUES OF JPART ON SUCCESSIVE CALLS SHOULD BE 1,2,3,4.
C THE PACKED RULE STRING IS FOUND IN PACKED RULE(1:).
C FOR PROPER RULE PACKING, USE SUBROUTINE RPACKC.
C IN THIS VERSION, THE RULE IS PACKED AS:
C BYTE 1 : FIRST 4 BITS: LS
C          NEXT 4 BITS: LRE
C BYTE 2 : FIRST 4 BITS: LLE
C          NEXT 4 BITS: LT
C NEXT (LS-1) BYTES: S(2:LS)
C NEXT (LRE) BYTES: RE(1:LRE)
C NEXT (LLE) BYTES: LE(1:LLE)
C NEXT (LT) BYTES: T(1:LT)
C
C
C RETURNS IERR > 0 IFF ERROR
C
C LOCAL DATA
      INTEGER*2 LX
C CODE
      IERR=0
D     TYPE *,' IN RUNPACKC, JPART=',JPART
      IF (JPART .EQ. 1) THEN
        LX=ICHAR(PACKED_RULE(1:1))
D        TYPE *,' FIRST BYTE=',LX
        L(1)=LX/16
D        TYPE *,' L(1)=',L(1)
        L(2)=LX-(L(1)*16)
D        TYPE *,' L(2)=',L(2)
```

```
          LX=ICHAR(PACKED_RULE(2:2))
D          TYPE *,' SECOND BYTE=',LX
          L(3)=LX/16
D          TYPE *,' L(3)=',L(3)
          L(4)=LX-(L(3)*16)
D          TYPE *,' L(4)=',L(4)
          LPR=L(1)+L(2)+L(3)+L(4)+2
D          TYPE *,' LPR=',LPR
          I=2
        ENDIF
        LX=L(JPART)
        IF (LX .GT. 0) RULE_PART=PACKED_RULE(I+1:I+LX)
200     I=I+LX
9999    RETURN
        END
```

H. FILE BMATCH2.FOR

```
        LOGICAL FUNCTION BMATCH2(PAT,S,IL,IDEL,ILIM,J,IRLS)
        CHARACTER PAT
        CHARACTER*(*) S
        INTEGER*2 IL,IDEL,ILIM,J,IRLS
C
C BMATCH2 RETURNS .TRUE. IFF THE PATTERN ELEMENT IN PAT
C MATCHES STRING S BEGINNING AT S(IL:IL), NOT LOOKING
C BEYOND S(ILIM:ILIM).
C IRLS IS THE RULE SET NUMBER
C IF PAT DENOTES A LIST OF ALTERNATIVE PATTERNS,
C BMATCH2 FIRST TRIES THE 'J + 1'TH ALTERNATIVE.
C IF SUCCESSFUL, BMATCH2 RETURNS IDEL=THE NUMBER OF
C CHARACTERS MATCHED IN S
C
        INCLUDE '[FISHER.PROD]COMUDS.FOR'
        INCLUDE '[FISHER.PROD]COMRDS.FOR'
C
C LOCAL DATA:
        INTEGER*2 UDS_BASE,IPAT,IR,IUDS,IAT1,JLIM,J2
D       TYPE *,' BMATCH2 ENTERED'
        IDEL=0
        IPAT=ICHAR(PAT)
        J=J+1
D       TYPE *,' ICHAR(PAT)=IPAT=',IPAT
D       TYPE *,'  IL=',IL,', ILIM=',ILIM
D       DO 69 IDB=IL,ILIM
D       TYPE*,'    I=',IDB,',ICHAR(S(I:I))=',ICHAR(S(IDB:IDB))
D69     CONTINUE
D       TYPE *,' ALTNO=J',J
C HANDLE USER-DEFINED SYMBOLS
        IF (IPAT .LT. MIN_UDS_CODE(IRLS)) GO TO 200
        IF (IPAT .GT. MAX_UDS_CODE(IRLS)) GO TO 200
D       TYPE *,' UDS CHARACTER'
        UDS_BASE=UDS_OFFSET(IRLS)
        IUDS=UDS_BASE + (IPAT - MIN_UDS_CODE(IRLS) + 1)
        IF (UDSTYPE(IUDS) .EQ. 1) GO TO 100
C UDS TYPE 2
D       TYPE *,' TYPE 2'
        IF ((NCHRALT1(IUDS) .EQ. 0) .AND. (J .EQ. 1)) THEN
           IDEL=0
           GO TO 8888
           ENDIF
```

```
      IR=IL+NCHRALT1(IUDS)+J-2
      IF (IR .GT. ILIM) GO TO 7777
      IALT1=IUSYM1(UDSNBR(IUDS))
      JLIM=NUSYMALT(UDSNBR(IUDS))
      J2=1
      CALL AMATCH2(S,IR,ILIM,ALT(IALT1),LALT(IALT1),J2,JLIM,
     +   IDEL2)
      IF (J2 .GT. JLIM) GO TO 7777
      IDEL=IR-IL+1
      GO TO 8888
100   CONTINUE
C UDS TYPE 1
D     TYPE *,' TYPE 1'
      IALT1=IUSYM1(IUDS)
      JLIM=NUSYMALT(IUDS)
      CALL AMATCH2(S,IL,ILIM,ALT(IALT1),LALT(IALT1),J,JLIM,
     +                        IDEL)
      IF (J .GT. JLIM) GO TO 7777
      GO TO 8888
200   CONTINUE
C HANDLE NON-SPECIAL CHARACTERS
      IF (IL .GT. ILIM) GO TO 7777
D     TYPE *,' NON-SPECIAL CHARACTER'
      IF (J .GT. 1) GO TO 7777
      IF (PAT .NE. S(IL:IL)) GO TO 7777
      IDEL=1
      GO TO 8888
C FAILURE
7777  CONTINUE
      BMATCH2=.FALSE.
D     TYPE *,' BMATCH2 FAILED'
      GO TO 9999
C SUCCESS
8888  CONTINUE
      BMATCH2 = .TRUE.
D     TYPE *,' BMATCH2 SUCCEEDED'
C EXIT
9999  CONTINUE
      RETURN
      END
```

I. FILE BLMATCH2.FOR

```
      LOGICAL FUNCTION BLMATCH2(PAT,S,IR,IDEL,J,IRLS)
      CHARACTER PAT
      CHARACTER*(*) S
      INTEGER*2 IR,IDEL,J,IRLS
C
C BLMATCH2 RETURNS .TRUE. IFF THE PATTERN ELEMENT IN PAT
C MATCHES STRING S ENDING AT S(IR:IR).
C IRLS IS THE RULE SET NUMBER
C IF PAT DENOTES A LIST OF ALTERNATIVE PATTERNS,
C BLMATCH2 FIRST TRIES THE 'J + 1'TH ALTERNATIVE.
C IF SUCCESSFUL, BLMATCH2 RETURNS IDEL=THE NUMBER OF
C CHARACTERS MATCHED IN S
C
      INCLUDE '[FISHER.PROD]COMUDS.FOR'
      INCLUDE '[FISHER.PROD]COMRDS.FOR'
C
C LOCAL DATA:
```

```
      INTEGER*2 UDS_BASE,IPAT,IUDS,IL,IALT1,JLIM,J2
D     TYPE *,' BLMATCH2 ENTERED'
      IDEL=0
      IPAT=ICHAR(PAT)
      J=J+1
D     TYPE *,'   ICHAR(PAT)=IPAT=i,IPAT
D     TYPE *,'   IR=',IR
D     IDB1=IR-5
D     IF (IDB1 .LT. 1) IDB1=1
D     DO 69 IDB=IDB1,IR
D     TYPE *,'   I=',IDB,',ICHAR(S(I:I))=',ICHAR(S(IDB:IDB))
D69   CONTINUE
D     TYPE *,'   ALTNBR=J=',J
C HANDLE USER-DEFINED SYMBOLS
      IF (IPAT .LT. MIN_UDS_CODE(IRLS)) GO TO 200
      IF (IPAT .GT. MAX_UDS_CODE(IRLS)) GO TO 200
D     TYPE *,' UDS CHARACTER'
      UDS_BASE=UDS_OFFSET(IRLS)
      IUDS=UDS_BASE+(IPAT-MIN_UDS_CODE(IRLS)+1
      IF (UDSTYPE(IUDS) .EQ. 1) GO TO 100
C UDS TYPE 2
D     TYPE *,'  TYPE 2'
      IF ((NCHRALT1(IUDS) .EQ. 0) .AND. (J .EQ. 1)) THEN
          IDEL=0
          GO TO 8888
          ENDIF
      IL=IR-NCHRALT1(IUDS)-J+2
      IF (IL .LT. 1) GO TO 7777
      IALT1=IUSYM1(UDSNBR(IUDS))
      JLIM=NUSYMALT(UDSNBR(IUDS))
      J2=1
      CALL ALMATCH2(S,IL,ALT(IALT1),LALT(IALT1),J2,JLIM,IDEL)
      IF (J2 .GT. JLIM) GO TO 7777
      IDEL=IR-IL+1
      GO TO 8888
100   CONTINUE
C UDS TYPE 1
D     TYPE *,' TYPE 1'
      IALT1=IUSYM1(IUDS)
      JLIM=NUSYMALT(IUDS)
      CALL ALMATCH2(S,IR,ALT(IALT1),LALT(IALT1),J,JLIM,IDEL)
      IF (J .GT. JLIM) GO TO 7777
      GO TO 8888
200   CONTINUE
C HANDLE NON-SPECIAL CHARACTERS
      IF (IR .LT. 1) GO TO 7777
D     TYPE *,' NON-SPECIAL CHARACTER'
      IF (J .GT. 1) GO TO 7777
      IF (PAT .NE. S(IR:IR)) GO TO 7777
      IDEL=1
      GO TO 8888
C FAILURE
7777  CONTINUE
      BLMATCH2=.FALSE.
D     TYPE *,' BLMATCH2 FAILED'
      GO TO 9999
C SUCCESS
8888  CONTINUE
      BLMATCH2 = .TRUE.
```

```
D       TYPE *,' BLMATCH2 SUCCEEDED'
C EXIT
9999    CONTINUE
        RETURN
        END
```

J. SUBROUTINE AMATCH2.FOR

```
        SUBROUTINE AMATCH2(S,IL,ILIM,C,L.J,JLIM,IDEL)
        CHARACTER*(*) S
        CHARACTER*(*) C(128)
        INTEGER*2 IL,ILIM,J,JLIM,IDEL
        INTEGER*2 L(128)
C
C C(I) IS A TABLE OF ARBITRARY STRINGS
C AMATCH2 SEARCHES THIS TABLE, TRYING TO FIND A STRING IN C
C THAT MATCHES THE CHARACTERS IN STRING S BEGINNING WITH
C S(IL:IL).  THE SEARCH IS LINEAR, STARTING WITH C(J)
C AND ENDING WHEN J > JLIM OR A MATCH OCCURS.
C ON SUCCESS, J POINTS TO THE MATCHED ENTRY AND IDEL
C CONTAINS L(J), THE LENGTH OF C(J) IN NUMBER OF
C CHARACTERS.  ON FAILURE, J > JLIM.
C
        GO TO 200
100     CONTINUE
        J=J+1
200     CONTINUE
        IF (J .GT. JLIM) GO TO 999
        IR=IL+L(J)-1
        IF (IR .GT. ILIM) GO TO 100
        IF (S(IL:IR) .NE. C(J)(1:L(J))) GO TO 100
        IDEL=L(J)
999     CONTINUE
        RETURN
        END
```

K. SUBROUTINE ALMATCH1.FOR

```
        SUBROUTINE ALMATCH2(S,IR,C,L,J,JLIM,IDEL)
        CHARACTER*(*) S
        CHARACTER*(*) C(128)
        INTEGER*2 IR,J,JLIM,IDEL
        INTEGER*2 L(128)
C
C C(I) IS A TABLE OF ARBITRARY STRINGS
C ALMATCH2 SEARCHES THIS TABLE, TRYING TO FIND A STRING IN C
C THAT MATCHES THE CHARACTERS IN STRING S ENDING WITH
C S(IR:IR).  THE SEARCH IS LINEAR, STARTING WITH C(J)
C AND ENDING WHEN J > JLIM OR A MATCH OCCURS.
C ON SUCCESS, J POINTS TO THE MATCHED ENTRY AND IDEL
C CONTAINS L(J), THE LENGTH OF C(J) IN NUMBER OF
C CHARACTERS.  ON FAILURE, J > JLIM.
C THIS IS A VARIANT OF AMATCH2 FOR LEFT-LOOKING SEARCHES.
C
        GO TO 200
100     CONTINUE
        J=J+1
200     CONTINUE
        IF (J .GT. JLIM) GO TO 999
```

```
      IL = IR - L(J) + 1
      IF (IL .LT. 1) GO TO 100
      IF (S(IL:IR) .NE. C(J)(1:L(J))) GO TO 100
      IDEL=L(J)
999   CONTINUE
      RETURN
      END
```

What is claimed is:

1. A method for transforming a series of input byte strings of text data into a series of speech allophones using automated apparatus, each input byte string including a left environment portion, a right environment portion, and an input byte value adjacent and between the left and right environment portions, comprising the steps of:

storing a plurality of rule sections, each comprising a number of transforming rules, within a rule set;

defining by the user a set of special symbols each matching more than one kind or number of characters that can possibly appear in the input byte string;

selectively using the special symbols in defining a left environment, right environment and source part of each rule;

providing an index table in said rule set comprising a plurality of pointers, each pointer pointing to a respective rule section;

comparing an input byte value of the input byte string sequentially to said pointers to determine if a match exists between the input byte value and one of the pointers;

if a match between said input byte value and a pointer exists, pointing to a corresponding rule section;

sequentially comparing each rule in the rule section with the input byte string until a match is made, or until all rules of the rule section have been compared the last said step of sequentially comparing including the substeps of:

comparing a left environment portion of the rule to a left environment portion of the input byte string;

comparing a right environment portion of the rule to a right environment portion of the input byte string; and if a sufficient match between the respective left and right environment portions exists, transforming the input byte string with an output part of the matched rule to obtain transformed output data that more closely conforms to a speech allophone recognizable by a speech synthesizer.

2. The method of claim 1 and further comprising, for each rule set, the steps of:

storing the input byte string in an input memory buffer;

providing an output memory buffer for the transformed output data processed by the rule set; and moving an output part of a matching rule to the output memory buffer.

3. The method of claim 1, and further comprising the step of providing a header for the rule set that includes instructions for dropping the input byte value of the input byte string if none of the rules in said rule set apply to the byte value.

4. The method of claim 1, and further comprising the step of providing a header for the rule set that includes instructions for transforming the input byte value of the input byte string unchanged to a byte value in said transformed output data if none of said rules in the rule set apply.

5. The method of claim 1 and further comprising:

storing plural rule sets; and applying subsequent ones of said rule sets in sequence to said transformed output data to produce speech allophones recognizable by a speech synthesizer.

6. The method of claim 5 and further comprising the steps of:

storing a set of special symbols for each rule set; and utilizing each said set of special symbols in conjunction with respective rule sets.

7. The method of claim 1 wherein at least one of said special symbols points to a list of selected character values, such that a byte value matching any of the selected character values will match the special symbol pointing to the selected character values.

8. The method of claim 1 wherein at least one of said special symbols represents N-or-more concatenate character patterns for comparison to a plurality of adjacent byte values in said input byte string, N being preselected as any integer.

9. The method of claim 1, and further including the steps of:

providing a drop/pass indicator for the rule set;

passing the input byte string to the output data in response to no match being obtained to any rule within a pointed-to rule section in the rule set if the drop/pass indicator of the rule set indicates that unmatched data is to be passed; and not passing the input byte string in response to no match being obtained to any rule within a pointed-to rule section in the rule set if the drop/pass indicator of the rule set indicates that unmatched data is to be dropped.

10. The method of claim 1, and further comprising the steps of:

pointing to a subsequent rule section having a pointer matching said input byte value if a match of a rule in a previously pointed-to rule section has not yet been made;

comparing the left environment and right environment of each rule in the subsequent rule section with the left and right environments of the input byte string until a match is obtained or the rules of the subsequent section are exhausted; and repeating the last said steps of pointing and comparing for all rule sections having pointers matching said input byte value until a match of the respective environments is made or until all of rules in the last said rule sections are exhausted.

11. The method of claim 5, wherein at least one of said special symbols represents one or more other special symbols.

12. The method of claim 8, wherein each said concatenate symbol pattern comprises at least one further special symbol.

* * * * *